United States Patent [19]

Waples

[11] Patent Number: 4,768,243

[45] Date of Patent: Sep. 6, 1988

[54] LATCH FOR A DROP SIDE CRIB

[75] Inventor: David G. Waples, East Aurora, N.Y.

[73] Assignee: The Quaker Oats Company, Chicago, Ill.

[21] Appl. No.: 107,377

[22] Filed: Oct. 9, 1987

[51] Int. Cl.[4] ..... A47D 7/02

[52] U.S. Cl. ..... 5/100; 292/7; 292/336.3; 292/DIG. 27

[58] Field of Search ..... 5/100, 93 R; 292/336.3, 292/7, DIG. 27

[56] References Cited

U.S. PATENT DOCUMENTS

| | | | |
|---|---|---|---|
| 1,275,762 | 8/1918 | Safford | 5/100 |
| 1,465,414 | 8/1923 | Boardman . | |
| 1,557,013 | 10/1925 | Boardman . | |
| 1,612,080 | 12/1926 | Waddington . | |
| 1,622,387 | 3/1927 | Marquardt . | |
| 1,705,851 | 3/1929 | Bukolt . | |
| 2,011,909 | 8/1935 | Rece | 5/100 |
| 2,369,834 | 2/1945 | Lundin | 5/100 |
| 2,448,317 | 8/1948 | Lineberry | 5/100 |
| 2,473,914 | 6/1949 | Shaw | 5/100 |
| 2,599,663 | 6/1952 | Schutzer | 5/331 |
| 2,640,203 | 6/1953 | Sheldon | 5/100 |
| 2,979,738 | 4/1961 | Goldberg | 5/331 |
| 3,541,619 | 11/1970 | Morrison | 5/100 |
| 3,634,894 | 1/1972 | Harbison | 5/100 |
| 3,649,673 | 3/1972 | Benoit | 5/100 |
| 3,786,524 | 1/1974 | Mathou | 5/100 |
| 3,846,854 | 11/1974 | Bryant | 5/100 |
| 3,896,514 | 7/1975 | Feldstein | 5/100 |
| 3,900,907 | 8/1975 | Mulder | 5/100 |
| 3,934,282 | 1/1976 | Bryant | 5/100 |
| 4,530,528 | 7/1985 | Shamie | 292/60 |
| 4,703,524 | 11/1987 | Brunner | 5/100 |
| 4,706,312 | 11/1987 | Shamie | 5/100 |

*Primary Examiner*—Reinaldo P. Machado
*Attorney, Agent, or Firm*—Cumpston & Shaw

[57] ABSTRACT

An improved latch for a drop side crib having at least one drop-side movably disposed between two crib ends includes locking means carried by the movable side for engaging at least one of the ends to fix the position of the side with respect to the ends. Inaccessible actuating means on the side are effective to release the locking means, to allow the crib side to be moved. Manually operable control means are provided having a first disengaged position in which movement of the control means does not operate the actuating means to release the side; and a second, engaged position where movement of the control means operates the actuating means to release the side for adjustment or removal.

24 Claims, 4 Drawing Sheets

LATCH FOR A DROP SIDE CRIB

This invention relates in general to drop side cribs and more particularly to a new latch for such cribs.

Drop side cribs, that is cribs with sides that are movable among a plurality of positions at different heights and which, in some instances, can be lowered completely and moved out of the way beneath the mattress frame to provide improved access to the mattress to permit the sheets to be changed easily, are well known. It is important to provide a reliable latch for the drop side of such a crib that cannot be inadvertently released. It is desirable to provide a double or triple acting latch that is more difficult for young children to operate than a simple latch. While a number of double acting latches have heretofore been proposed, there is a need for an even better latch. Accordingly, it is an object of this invention to provide an improved latch for a drop side crib.

Briefly stated, in accordance with a presently preferred embodiment of this invention, an improved latch for a drop side crib having at least one drop-side movably disposed between two crib ends includes locking means carried by the movable side for engaging at least one of the ends to fix the position of the side with respect to the ends. Inaccessible actuating means on the side are effective to release the locking means, to allow the crib side to be moved. Manually operable control means are provided having a first disengaged position in which movement of the control means does not operate the actuating means to release the side; and a second, engaged position where movement of the control means operates the actuating means to release the side for adjustment or removal.

In accordance with a more particular embodiment of this invention, the drop side has a horizontally disposed top rail into which the latch mechanism is fitted. The latch mechanism itself has a movable shuttle disposed in an elongated groove formed in the rear surface of the rail, and first and second locking rods disposed in grooves extending longitudinally with respect to the rail to the ends of the crib for engaging locking plates, as will be more completely described below. The movable shuttle has an actuating lug projecting through a slot in the top rail adjacent to tracks mounted on the rail, which tracks carry a control slide having a button at one end, which button may be depressed to engage the actuating lug and move the shuttle and the locking rods in their grooves when the control is moved. However, when the button is not depressed, the control may be moved without having any effect on the shuttle and therefore not releasing the drop side.

In accordance with a still further embodiment of this invention, the ends of the elongated locking rods are attached to locking members with enlarged heads on the ends thereof for engaging lock plates with keyhold shaped openings mounted in the ends of the crib, so that the rods cannot be retracted unless the drop side is lifted slightly. To this end, the lock plates have generally keyhole shaped openings, the upper portion of which will pass the enlarged head therethrough while the lower portion is only slightly larger than the shaft of the rod and will not allow the locking member to be withdrawn. Thus a triple acting lock is provided that must be lifted, pushed and slid to release the side.

While the novel aspects of the invention are defined with particularity in the appended claims, the invention itself together with further objects and advantages thereof may be more readily appreciated by reference to the following detailed description of the presently preferred embodiment of the invention taken in conjunction with the accompanying drawings in which:

Figure 1:
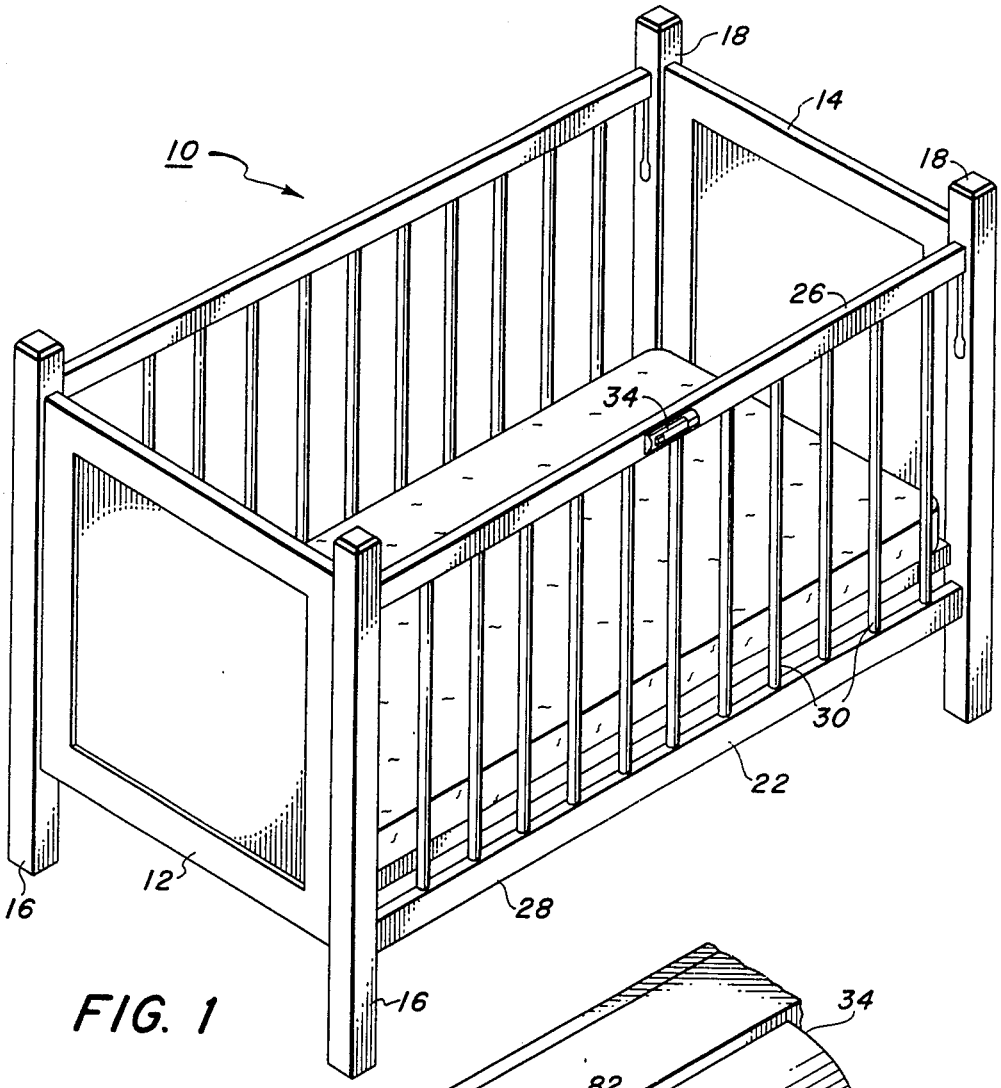
FIG. 1 is a perspective view of a drop side crib fitted with a latch in accordance with this invention.

Referring now to FIG. 1, a drop side crib 10 has two ends 12 and 14 each end having a pair of supporting legs 16 and 18 respectively. A drop side 22 is releasably disposed between the ends and preferably includes top and bottom rails 26 and 28 and a barrier therebetween formed, for example, by a plurality of rods 30.

A control assembly 34 for a latch mechanism for securing the drop side is disposed at approximately the center of the top rail.

Figure 2:
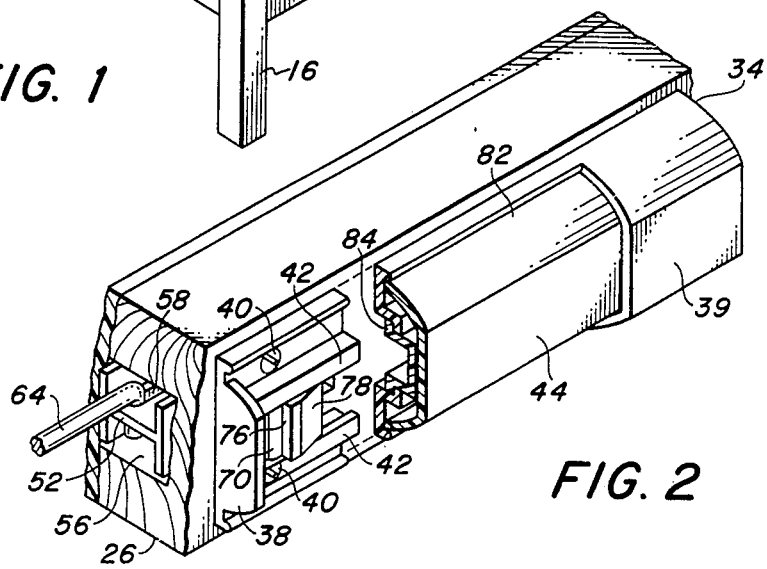
FIG. 2 is a fragmentary view, partially in section, of a portion of the top rail of the crib of FIG. 1 and the operating portion of the latch of this invention.

The control assembly 34 of the latch mechanism is illustrated in a fragementary perspective view in FIG. 2. The assembly 34 includes a combination track and outer housing member 38 that is attached to the top rail of the drop side by suitable fasteners, such as the two screws 40 visible in this figure and in FIGS. 6 and 7. The housing member 38 includes a two rail track 42 including two upstanding L-shaped rail members carrying a slidable control member 44 only a portion of which is seen in FIG. 2. The housing has a hood 39 closing one end. The slidable control member has a button portion 48 formed on a live hinge 50, as most readily seen in FIG. 5. A shuttle 52 is disposed in an elongated groove 56 cut in the rear surface of rail 26. The shuttle is generally H-shaped in cross section and includes two slots 58, 60, each receiving the bent over end of one of a pair of retractable locking rods 64, 66, as may be more clearly seen in FIG. 3. The shuttle has an actuating lug 70 attached thereto that extends through a slot 72 in the top rail 26, that allows the shuttle to operatively communicate with the slidable control member 44 (control slide). The upper surface of the actuating lug 70 has a shoulder 76 for engaging a complementary surface on the button 48 and ramp 78 for guiding the button over the actuating lug 70 when the control slide 44 is moved from right to left as seen in FIG. 2, even though the button 48 is depressed slightly.

Figure 6:
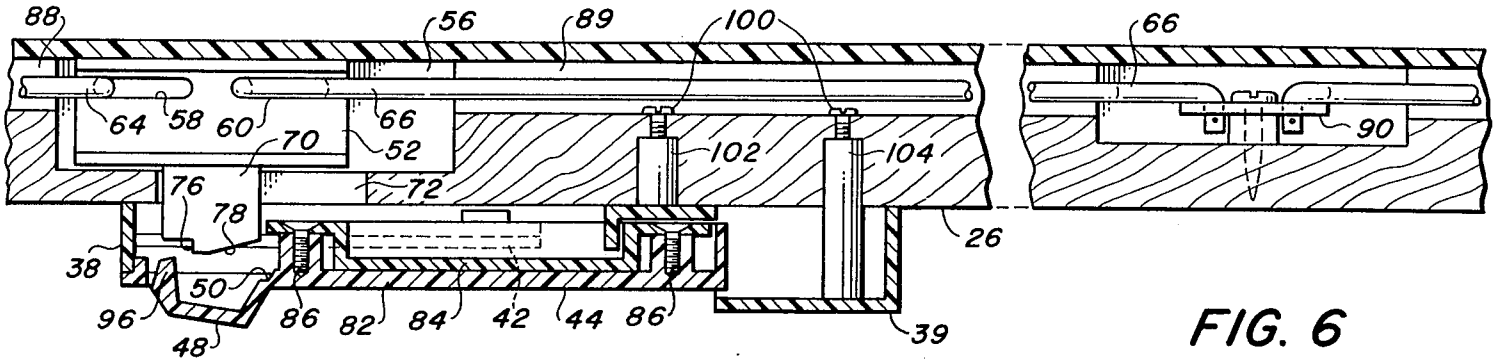
FIG. 6 is an enlarged section taken along line 6—6 of FIG. 3, showing the latch in its locked position.
Figure 7:
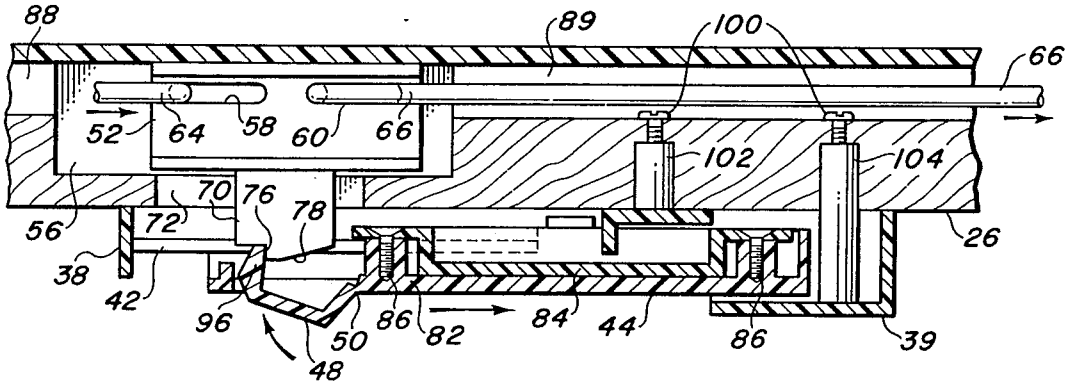
FIG. 7 is a partial view of the latch of FIG. 6 in its released position.

The control slide member 44 is formed from upper and lower members 82, 84 held together by screws 86 or similar fasteners as is most clearly seen in FIGS. 6 and 7. The lower control slide member 82 engages the underneath side of the upstanding rails of the two rail track 42, while the upper control slide member 44 engages the upper surface of the outer housing member 38 adjacent to the rails, as is most clearly seen in FIG. 2. The slidable control member 44 is thereby slidably retained on the track.

Figure 3:
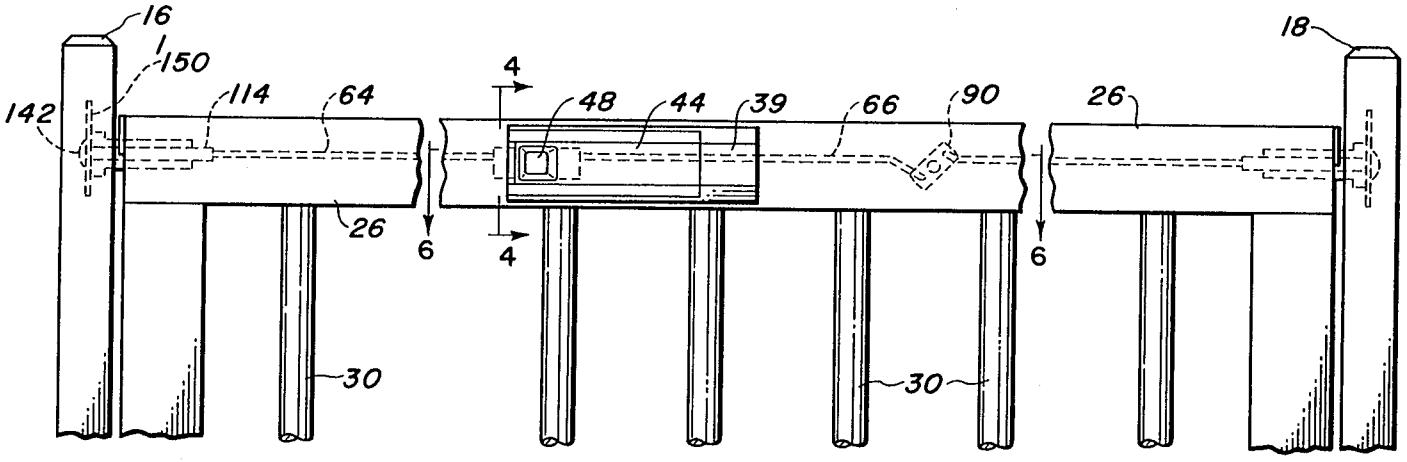
FIG. 3 is a fragmentary front-elevational view of the upper portion of a crib having a latch in accordance with this invention.

As seen in FIG. 3, the shuttle 52 is connected to one end of each of the retractable locking rods 64, 66 which are preferably carried in grooves 88, 89 formed in the back of the top rail extending to the left and right edges of the rail and communicating with the shuttle groove 56. The right locking rod 66 is connected to a bell crank assembly 90 that is pivotally mounted on the top rail, so that moving the control slide 44 from left to right as shown in FIG. 3 simultaneously retracts both locking rods. The structure of the ends of the locking rods and their interaction with plates that are attached to the ends of the crib will be more completely discussed in connection with FIGS. 8–11.

Figure 5:
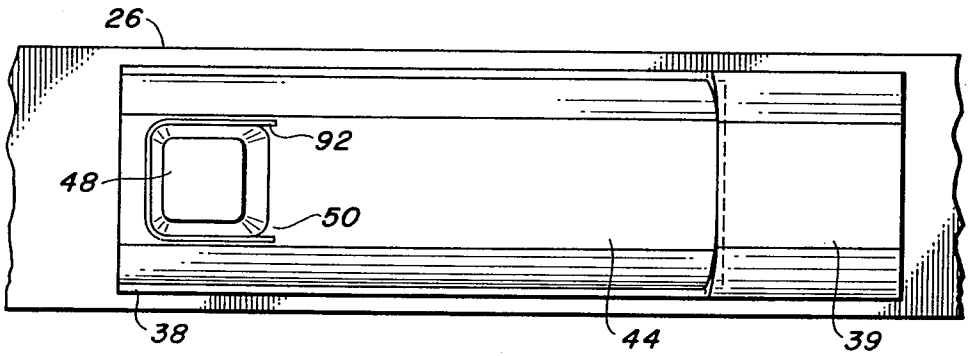
FIG. 5 is an enlarged front-elevational view of the control mechanism shown in FIG. 3.
Figure 4:
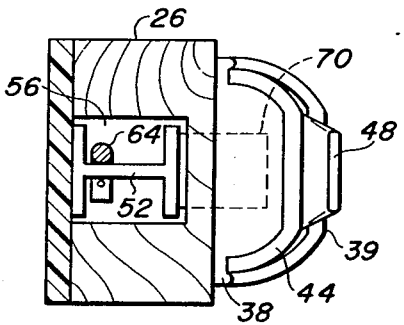
FIG. 4 is a section taken along lines 4—4 of FIG. 3.

FIGS. 4 and 5 show the control button 48 formed adjacent the left edge of the control slide 44 and surrounded by a groove 92 on 3 sides to provide a resilient hinged button structure that can be depressed to cause the button to engage the actuating lug 70 on the slidable shuttle 52. If the control slide 44 is moved from left to right without depressing the button 48, then the button passes over the top of the lug and does not move the shuttle and release the locking rods. Only by depressing the button before moving the control slide will the drop side of the crib be released. This may be more clearly seen by reference to FIGS. 6 and 7 that show the control assembly of the shuttle in section.

Referring now to FIG. 6, the latch assembly is shown with the control slide 44 in its normal position. The retractable locking rods 64, 66 are extended and the drop side is locked in place. If the control slide 44 is simply moved to the right as if to retract the locking bars but the button is not depressed, the actuating lug engaging portion 96 of the button 48 will pass over the top of the lug 70 as the control slide 44 is moved from left to right, and the shuttle will remain in the locked position shown in FIG. 6. In order to retract the locking rods, the button 48 must be depressed as shown in FIG. 7 before the control slide 44 is moved, whereupon the button engages the lug on the shuttle and as the slide is moved from left to right the shuttle 52 is moved in its groove 56, thereby pulling the left hand locking rod and retracting the end thereof, as will be more fully explained below, and pushing the right-hand locking rod 66 to pivot the bell crank and retract the end of the rod.

As seen in FIG. 7, the outer housing member 38 is also fastened to the upper rail of the drop side by additional screws 100 that engage bosses 102, 104 extending into the rail.

Figure 8:
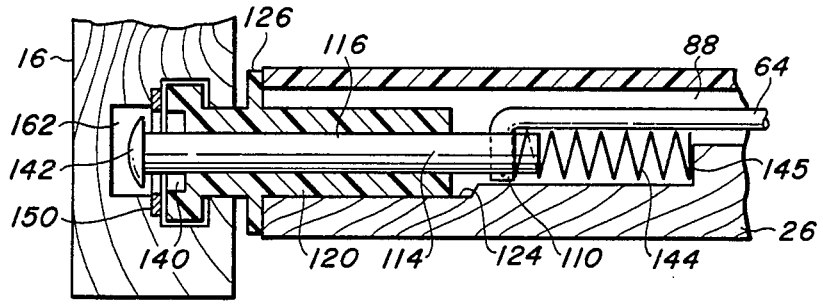
FIG. 8 is a section view taken from the top, of the end of the locking rod of this invention taken along line 8—8 of FIG. 9.
Figure 9:
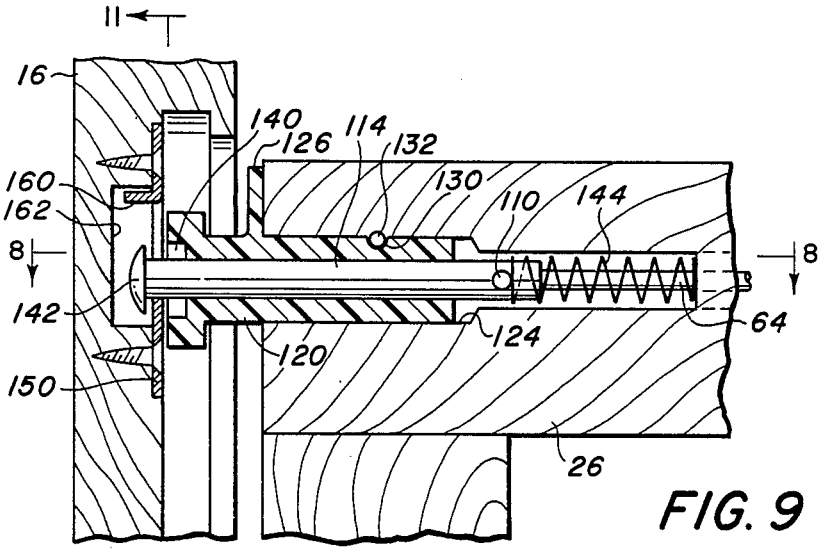
FIG. 9 is a fragmentary side sectional view of the locking rod of FIG. 8.

It is a feature of this invention that a triple acting release mechanism may also be provided as shown in FIGS. 8 through 11. As illustrated in FIGS. 8 and 9, the free end 110 of the retractable locking rod 64 is preferably bent at approximately a right-angle and joined to the shaft 114 of a locking member 116. The end of rod 64 may be swedged or pinned to hold it in place as is well known. The locking member 116 is reciprocally mounted in a sleeve 120 attached to the end of the top rail 26 of the drop side 22. Preferably the sleeve 120 is received in a bore 124 communicating with the groove 88 in which the retractable locking rod 64 moves. The sleeve has an intermediate flange 126 bearing against the end of the top rail 26 for limiting the insertion of the sleeve 120 into the bore 124; and a notch 130 for engaging a pin or key 132 for holding the sleeve in position with respect to the rail 26. The remote end of the sleeve 120 includes a U-shaped recess 140 for receiving the enlarged head 142 of the locking member 116 when the member is retracted. A spring 144 engaging the locking member and a should 145 in the top rail biases the locking member to its extended position, as shown in FIGS. 7 and 8.

Figure 11:
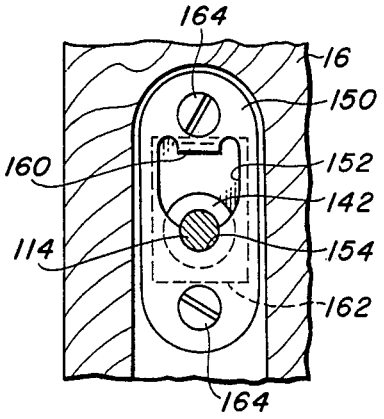
FIG. 11 is a section taken along line 11—11 of FIG. 9 showing the latch plate of this invention in the front elevation.

A locking plate 150 as seen in an elevational view in FIG. 11 has a generally key-hole shaped opening 152 therein, the lower portion 154 of which is slightly larger than the shaft 114 of the locking member 116, but smaller than the head 142 thereof, so that the locking member cannot be retracted when the shaft 114 is resting in the lower portion of the keyhole opening 152. In order to retract the shaft, the drop side must be lifted slightly, so that the head 142 of the locking member is raised above the lower portion of the keyhole-shaped opening, whereupon the head can be withdrawn from the opening and the drop side released.

Figure 10:
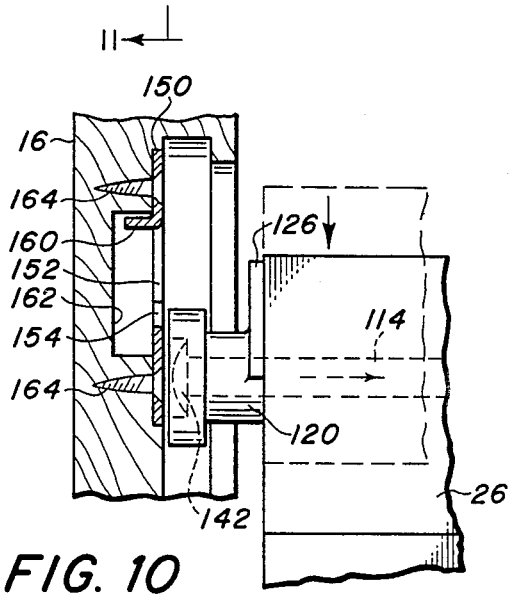
FIG. 10 is a side-elevational view, partly in section, of the end of the latching rod of this invention shown in FIG. 9 in its retracted position.

Preferably, a small tab 160 on the locking plate 150 is bent at approximately a 90° angle at the top of the opening, to prevent the enlarged head of the shaft from becoming caught behind the upper portion of the locking plate when the drop side of the crib is raised. A recess 162 cut in the leg 16 of the crib 10 receives the tab portion 160 of the locking plate, as well as the head of the locking membert. The locking plate 150 is preferably held in position with screws 164 or similar fasteners. When the locking member 116 is retracted as shown in FIG. 10, the head is received in the U-shaped recess 140 at the end of the sleeve 120, and the drop side may be moved to a desired new position. Though not shown, where a plurality of distinct heights for the drop side is desired, the locking plate assembly shown in FIGS. 8–11 is repeated at spaced apart intervals along the ends of the crib. Alternatively, where only the ability to swing the drop side out of the way beneath the crib is required, then only a single locking plate assembly is needed.

While the invention has been described in connection with a presently preferred embodiment thereof, those skilled in the art will recognize that various modifications and changes therein will be apparent to those skilled in the art. All such changes as fall within the true spirit and scope of the invention are intended to be encompassed by the appended claims.

What is claimed is:

1. In a crib having a releasable side disposed between first and second ends, an improved latch comprising:

locking means engaging at least one of said first and second ends for fixing the position of said releasable side;

actuating means on said releasable side and connected to said locking means for releasing said locking means; and manually operable control means on said releasable side selectively connectable with said actuating means and movable between a disengaged position in which said control means may be actuated with no effect on said locking means and an engaged position for in which said control means may be actuated for engaging said actuating means to release said locking means for allowing said side to be adjusted.

2. The improved latch of claim 1 wherein said locking means comprises at least one retractable rod engaging one of said ends.

3. The improved latch of claim 2 wherein said side comprises a top rail having a slot therein and said rod is disposed in said slot.

4. The improved latch of claim 1 comprising a track fixedly mounted on said side and said control means are slidably mounted on said track.

5. The improved latch of claim 3 wherein said actuating means comprises means slidably mounted in said side adjacent to said control means, and said rod is attached to said actuating means.

6. The improved latch of claim 5 wherein said control means further comprises button means on said control means movable between an active position engaging said actuating means and an inactive position disengaged from said actuating means.

7. The improved latch of claim 6 further comprising means resiliently urging said button means to said inactive position.

8. The improved latch of claim 7 wherein said button comprises an operating surface and a control surface, and said actuating means has a controlled surface cooperating with said control surface to allow said button to engage said actuating means and to cause said actuating means to slide when said control means are slid.

9. The improved latch of claim 3 wherein said track comprises first and second rails and said actuating means are disposed at least partially between said rails.

10. The improved latch of claim 8 wherein said rails are spaced from said side and said control means engages at least a portion of two surfaces of said track.

11. In a crib having a side releasably disposed between first and second ends, a double acting release mechanism comprising:

first and second retractable locking rods engaging said first and second ends respectively;

actuating means slidably mounted on said side and connected to said retractable locking rods for retracting said rods when said actuating means is slid to a release position;

depressible control means slidably mounted on said side, said control means engaging said actuating means only when depressed, whereby said side may be released only by both depressing and sliding said control means.

12. The double acting control mechanism of claim 10 wherein said side comprises an elongated recess and said actuating means comprises a shuttle slidably mounted in said recess and attached to said rods.

13. The double acting control mechanism of claim 12 further comprising first and second slots in said side, communicating with said recess, and said rods are disposed in said slots.

14. The double acting control mechanism of claim 13 further comprising a track mounted on said slide and said control means are slidably mounted on said track.

15. In a crib having a side releasable disposed between a first and second ends, a triple acting release mechanism comprising:

first and second retractable locking rods engaging said first and second ends respectively;

means on said locking rods engaging said sides for allowing said locking rods to be retracted only when said side is raised from its normal position;

actuating means slidably mounted on said side and connected to said locking rods for retracting said rods when said actuating means is slid to a release position; and depressible control means slidably mounted on said plate, said control means engaging said actuating means only when depressed, whereby said side may be released only by raising said side and depressing and sliding said control means.

16. The crib of claim 15 wherein said means on said locking rods engaging said sides comprises enlarged heads on said rods.

17. The crib of claim 16 further comprising locking plates on said ends, said plates having keyhole shaped openings for receiving said heads.

18. The crib of claim 17 wherein said actuating means comprises means slidably mounted in said side adjacent to said control means, and said rod is attached to said actuating means.

19. The crib of claim 18 wherein said control means further comprises button means on said control means movable between an active position engaging said actuating means and an inactive position disengaged from said actuating means.

20. The crib of claim 19 wherein means resiliently urging said button means to said inactive position.

21. The crib of claim 19 wherein said button comprises an operating surface and a control surface, and said actuating means has a controlled surface cooperating with said control surface to allow said button to engage said actuating means and to cause said actuating means to slide when said control means are slid.

22. The crib of claim 15 comprising a track fixedly mounted on said side and said control means are slidably mounted on said track.

23. The crib of claim 22 wherein said track comprises first and second rails and said actuating means are disposed at least partially between said rails.

24. The crib of claim 23 wherein said rails are spaced from said side and said control means engages at least a portion of two surfaces of said track.

* * * * *